US007174958B2

(12) United States Patent
Appleton

(10) Patent No.: US 7,174,958 B2
(45) Date of Patent: Feb. 13, 2007

(54) DRILL STRING MEMBER

(76) Inventor: Robert Patrick Appleton, Glenburn House, Tornaveen, By Torphins GBN, Aberdeenshir, AB31 4NY (GB)

( * ) Notice: Subject to any disclaimer, the term of this patent is extended or adjusted under 35 U.S.C. 154(b) by 0 days.

(21) Appl. No.: 10/505,113

(22) PCT Filed: Feb. 20, 2003

(86) PCT No.: PCT/GB03/00735

§ 371 (c)(1),
(2), (4) Date: Oct. 18, 2004

(87) PCT Pub. No.: WO03/071089

PCT Pub. Date: Aug. 28, 2003

(65) Prior Publication Data

US 2005/0045386 A1 Mar. 3, 2005

(30) Foreign Application Priority Data

Feb. 20, 2002 (GB) ..... 0203956.8

(51) Int. Cl.
*E21B 17/22* (2006.01)
*E21B 17/18* (2006.01)
*F16L 9/02* (2006.01)
*E21B 37/00* (2006.01)

(52) U.S. Cl. ..... 166/242.1; 166/173; 166/241.1; 175/323; 138/177; 138/178; 138/DIG. 11

(58) Field of Classification Search ..... 166/311, 166/170, 173, 242.1, 241.1; 175/320, 323, 175/324, 325.1; 138/177, 178, DIG. 11
See application file for complete search history.

(56) References Cited

U.S. PATENT DOCUMENTS 2,667,931 A * 2/1954 Baker ..... 166/173
2,695,673 A * 11/1954 Coyle ..... 166/170
2,948,520 A * 8/1960 Densmore ..... 299/55
3,036,810 A * 5/1962 Conrad et al. ..... 251/95
3,085,639 A * 4/1963 Fitch ..... 175/323
3,125,173 A * 3/1964 Fox ..... 285/333
3,194,331 A * 7/1965 Arnold ..... 175/323
3,360,960 A * 1/1968 Massey ..... 464/183
3,405,771 A * 10/1968 Carr et al. ..... 175/73
3,446,297 A * 5/1969 Elliott et al. ..... 175/301
4,365,678 A * 12/1982 Fitch ..... 175/323
4,460,202 A * 7/1984 Chance et al. ..... 285/333
4,467,879 A 8/1984 Burge (Continued)

FOREIGN PATENT DOCUMENTS

GB 2164371 3/1986

(Continued)

*Primary Examiner*—Jennifer H. Gay
(74) *Attorney, Agent, or Firm*—Drinker Biddle & Reath LLP

(57) ABSTRACT

A drill-string member includes at least one grooved portion on an outer surface thereof. A pair of axially spaced-apart grooved portions are typically provided, with two such pairs axially spaced along the longitudinal length of the member. A plurality of grooves are milled into the grooved portions, and the grooves intersect with one another to form a criss-cross pattern. As the member is rotated, fluid flows up the grooves, where fluid from one groove meets fluid from another groove at each intersection, causing turbulence to be created.

19 Claims, 3 Drawing Sheets

U.S. PATENT DOCUMENTS

| | | | | | |
|---|---|---|---|---|---|
| 4,674,171 | A | * | 6/1987 | DeCell et al. | 29/558 |
| 4,771,811 | A | * | 9/1988 | DeCell et al. | 138/109 |
| 4,811,800 | A | * | 3/1989 | Hill et al. | 175/323 |
| 4,901,804 | A | | 2/1990 | Barron et al. | |
| 5,040,620 | A | * | 8/1991 | Nunley | 175/61 |
| 5,452,772 | A | | 9/1995 | Van Den Bergh | |
| 5,542,454 | A | | 8/1996 | Carlson et al. | |
| 5,676,501 | A | * | 10/1997 | Peetz et al. | 408/204 |
| 5,855,053 | A | * | 1/1999 | Arena | 29/523 |
| 6,056,073 | A | | 5/2000 | Boulet | |
| 6,688,399 | B2 | * | 2/2004 | Maguire et al. | 166/382 |
| 6,868,910 | B2 | * | 3/2005 | Corre et al. | 166/313 |
| 2004/0060699 | A1 | * | 4/2004 | Rastegar | 166/285 |
| 2004/0065445 | A1 | * | 4/2004 | Abercrombie et al. | 166/382 |

FOREIGN PATENT DOCUMENTS

| | | | |
|---|---|---|---|
| GB | 2164371 | A * | 3/1986 |
| GB | 2164372 | | 3/1986 |
| GB | 2166177 | | 4/1986 |

* cited by examiner

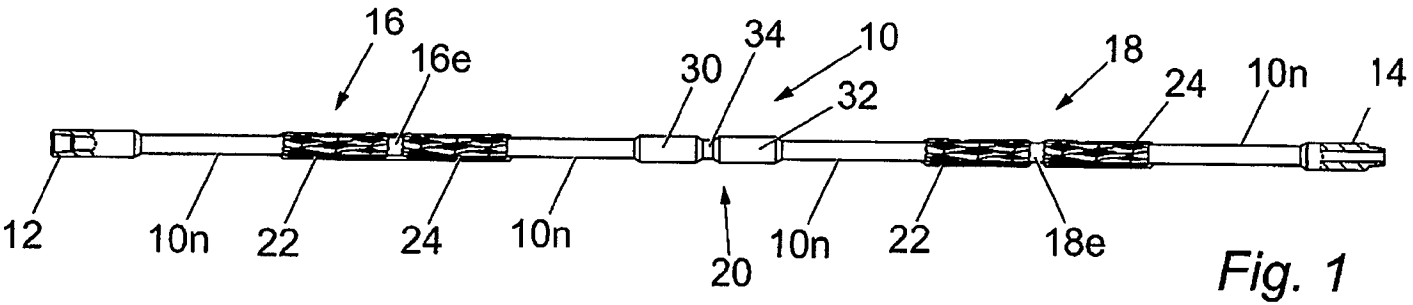
Fig. 1
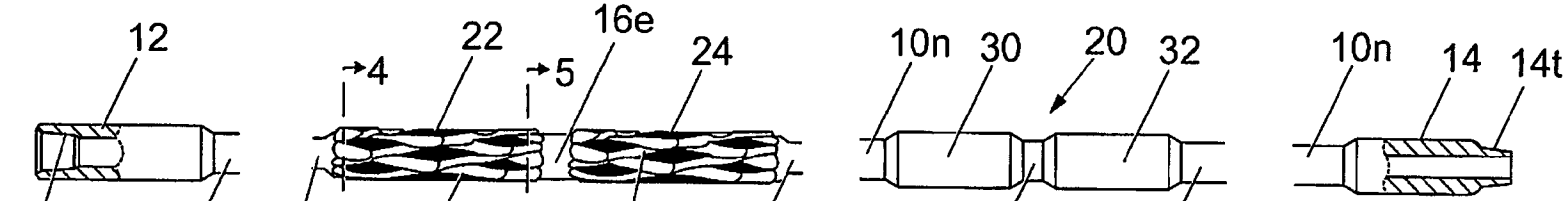
Fig. 2b
Fig. 7
Fig. 3
Fig. 2a
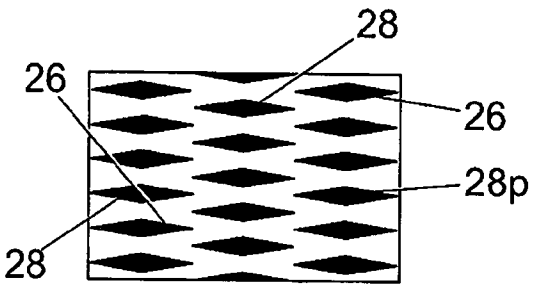
Fig. 6a
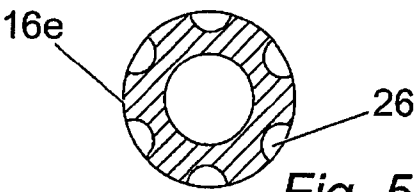
Fig. 5
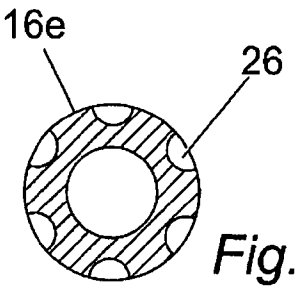
Fig. 4

DRILL STRING MEMBER

RELATED APPLICATION

This Application is the U.S. National Phase Application of PCT International Application No PCT/GB03/00735 filed Feb. 20, 2003.

FIELD OF THE INVENTION

The present invention relates to a drill-string member that is particularly, but not exclusively, suitable for creating turbulence in a borehole and/or reducing the build-up of cuttings and debris on a wall of the borehole.

DESCRIPTION OF THE RELATED ART

Conventionally, drill strings used when drilling boreholes into the ground are provided with a drill bit that rotates so that the drill bit cuts into the ground to form the borehole. Normally the whole string rotates (rotary drilling), but some bits are driven in rotation relative to a string that remains rotationally stationary.

BRIEF SUMMARY OF THE INVENTION

According to the present invention, there is provided a drill string member comprising a body including at least one portion having grooves on an outer surface thereof.

The body is typically tubular with an axial hollow conduit therethrough, and may have a nominal outer diameter of around 5 inches (approximately 127 mm). The or each grooved portion is typically provided on an enlarged diameter portion. The or each enlarged diameter portion typically has a diameter of around 6.5 inches (approximately 165 mm).

Two axially spaced-apart enlarged portions are typically provided. In one embodiment, up to four axially spaced-apart enlarged diameter portions are provided. In this embodiment, the four axially spaced-apart enlarged diameter portions are divided into two axially spaced-apart pairs of enlarged diameter portions. The enlarged diameter portions in each pair are typically also axially spaced-apart.

In one specific embodiment, the body includes two axially spaced-apart nominal diameter portions, with a pair of axially spaced-apart enlarged diameter portions on each nominal diameter portion. Optionally, the two nominal diameter portions are flexibly coupled together using a flexible coupling. The flexible coupling typically includes two axially spaced-apart collars with a reduced diameter portion between the collars. The diameter of the collars is typically the same as or slightly greater than the diameter of the enlarged diameter portions. The diameter of the reduced diameter portion is typically the same as or slightly less than the nominal diameter of the body.

The grooves are typically helical grooves. A plurality of helical grooves are typically provided on the or each enlarged diameter portion. In one embodiment, twelve helical grooves are provided. The helical grooves are typically formed by milling each groove into the enlarged diameter portion. The cross-sectional shape of the or each groove is preferably substantially symmetrical.

The grooves typically intersect with one another. The grooves typically create a plurality of islands therebetween, typically by means of the intersections. The islands typically have an outer diameter that is substantially the same as the outer diameter of the or each enlarged diameter portion. The grooves typically create a plurality of cutters. The cutters are typically formed by the peripheral edges of the islands.

As drilling fluid flows up each groove, it typically meets fluid from the other grooves at the intersections and thus produces a turbulence in the borehole.

The islands are typically polyhedral as a result of the intersections, and could be, e.g. diamond shaped, but this is not essential. Each peripheral edge of the polyhedral shape typically forms a cutter. Also, drilling fluid typically impacts on the peripheral edges of the diamond or other polyhedral, thereby enhancing the turbulence in the borehole.

In certain embodiments where the islands are diamond shaped, each corner of the diamond provides an apex. At least one apex typically faces in the direction of rotation of the string. This has the advantage that the sharp edge at the apex cuts into any debris in the borehole, or filtrate on the borehole wall to aid in dislodging the debris, filtrate and the like. Further, as the islands are diamond shaped, four cutters are typically provide for each island. Thus, there is a large cutting surface area. Further, at least two cutters typically formed by the peripheral edges face the direction of rotation.

An outer surface of the enlarged diameter portions (e.g. the islands) and/or the peripheral edges of the islands can be heat-hardened and/or provided with a coating of hard wearing material (e.g. tungsten carbide).

In one specific embodiment, the helical grooves are formed by milling a pair of diverging grooves into the enlarged diameter portion, each pair beginning at one of circumferentially spaced-apart starting points. Six starting points are typically provided, each starting point being equi-spaced around a circumference of the or each enlarged diameter portion, and are thus typically 60° apart. Each pair of grooves diverges at an angle of around 20° between the diverging grooves from each starting point.

Each groove is typically milled in a helix from each starting point to an axially and/or circumferentially spaced end point. Each end point is typically circumferentially spaced from each starting point by around 90° (that is, there is a 90° circumferential wrap between the start and end points of each groove). Each end point is typically axially spaced from each start point by around 30 inches (approximately 762 mm).

The apparatus typically includes attachment means to allow the tubular to be coupled into a string. The attachment means may be of any conventional type and typically comprises threaded connections (e.g. pin and box connections). However, the tubular may be welded or otherwise coupled into the string.

The apparatus typically includes a longitudinal throughbore to facilitate the passage of fluids therethrough.

The outer diameters of the grooved enlarged portions are typically a few percent narrower than the outer diameters of the collars e.g. 5–10% narrower, in order to space the grooved surface radially inward from the casing or borehole wall where the device is deployed. By doing this, the grooves have reduced contact with the casing wall causing less wear on the casing. A significant cleaning effect results from the turbulence created by the rotation of the grooved surface in close proximity to the borehole wall or casing, without the requirement for direct scraping or cutting by the grooved portions. In some embodiments the ODs of the grooved portions can be varied in the same string, so that some of the grooved portions can have a narrower OD than others in the same string. Some grooved portions can have a wider OD than the collars, whereas some grooved portions can have a narrower OD than the collars. Typically the difference between the ODs of the collar and the grooved portion is of the order of ½ inch to ⅛$^{th}$ inch (approximately 11–5 mm).

BRIEF DESCRIPTION OF THE SEVERAL VIEWS OF THE DRAWINGS

Embodiments of the present invention shall now be described, by way of example only, and with reference to the accompanying drawings, in which:

FIG. 1 is a side elevation of an exemplary embodiment of a drill string member;

FIGS. 2*a* and 2*b* are part cross-sectional side elevations of attachment means forming part of the member of FIG. 1;

FIG. 3 is an enlarged view of a portion of the member of FIG. 1 showing a plurality of helical grooves on an outer surface thereof;

FIG. 4 is a cross-sectional view taken along the line 4—4 in FIG. 3;

FIG. 5 is a cross-sectional view taken along the line 5—5 in FIG. 3;

FIG. 6*a* is a development of the grooved portion of the member shown in FIG. 3;

FIG. 7 is an enlarged view of a portion of the member of FIG. 1 showing a flexible coupling.

DETAILED DESCRIPTION OF THE INVENTION

Figure 6B:
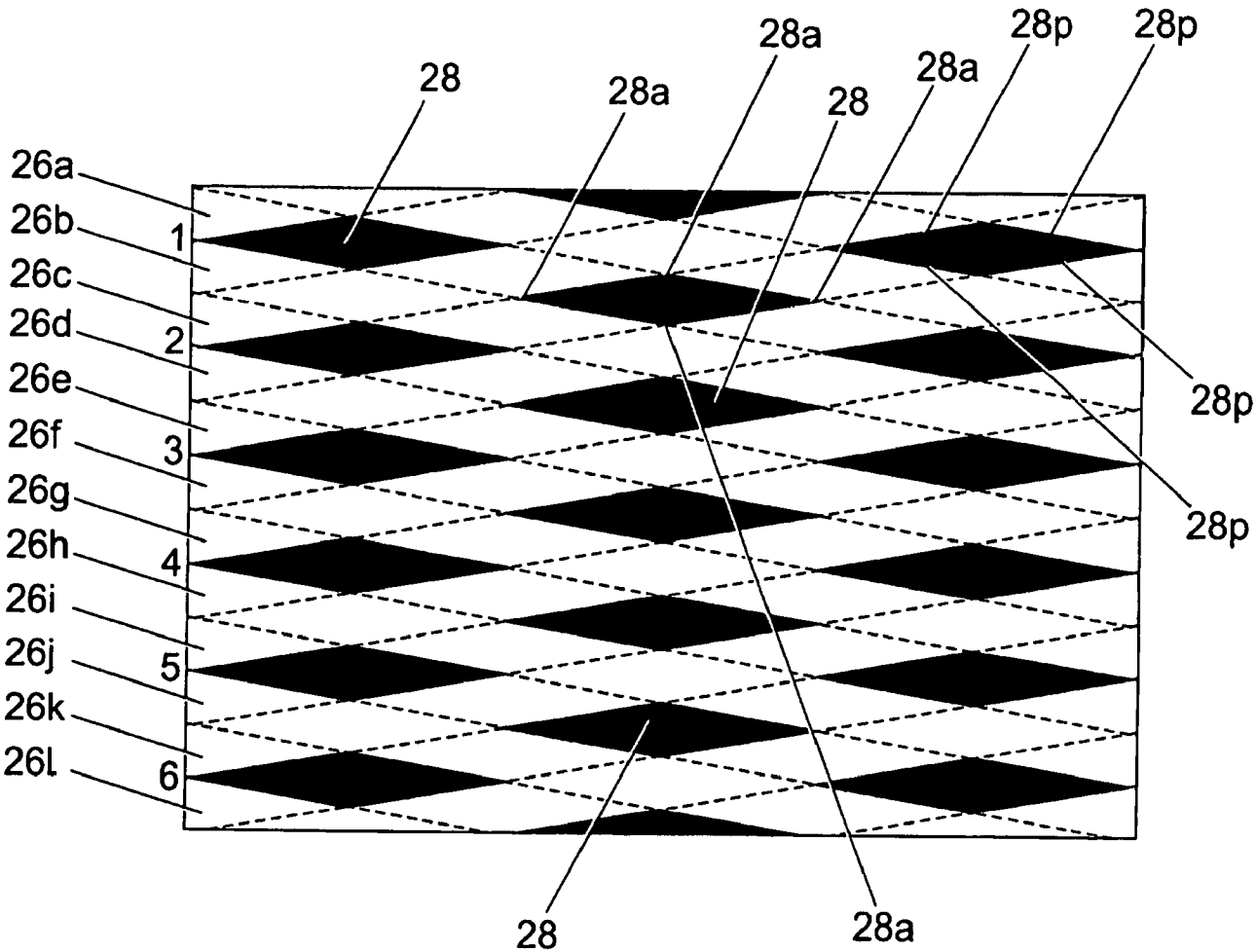
FIG. 6*b* is an enlarged view of the development of FIG. 6*a;*

Referring to the drawings, and FIGS. 1, 2*a* and 2*b* in particular, there is shown a downhole tubular 10 that includes attachment means in the form of a box 12 and a pin 14 to facilitate coupling of the tubular into a string (e.g. a drill string, not shown). The box 12 and pin 14 are best shown in is FIGS. 2*a* and 2*b* respectively, and are well known in the art. The box 12 typically includes internal screw thread 12*t* that is typically NC50 box thread, and the pin 14 typically includes external screw thread 14*t* that is typically NC50 pin thread.

The box 12 and pin 14 each have an outer diameter of around 7 inches (approximately 178 mm), and the box 12 has a longitudinal length of around 24 inches (approximately 610 mm), whereas the pin 14 has a longitudinal length of around 18 inches (approximately 457 mm).

Tubular 10 includes nominal diameter portions 10*n* that typically have a nominal outer diameter of 5 inches (approximately 127 mm), and a nominal inner diameter of around 3.5 inches (approximately 89 mm). Thus, the nominal diameter portions 10*n* are typically portions of 5 inch drill pipe. The longitudinal length of the nominal diameter portions 10*n* are typically 48 inches (approximately 1220 mm) at the pin 12 and box 14 connections, and 36 inches (approximately 915 mm) in length at the other nominal diameter portions 10*n*.

In this particular embodiment, the tubular 10 includes a first portion 16 and a second portion 18, the portions 16, 18 being coupled by a flexible joint 20 (best shown in FIG. 7). Portions 16, 18 are substantially the same and both include an enlarged diameter portion 16*e*, 18*e*. The maximum outer diameter of the enlarged diameter portions 16*e*, 18*e* is typically around 6.5 inches (approximately 165 mm), and each portion 16*e*, 18*e* has a nominal inner diameter of around 3.5 inches (approximately 89 mm).

Each enlarged diameter portion 16*e*, 18*e* typically has an overall length of around 63 inches (approximately 1600 mm), and each portion 16*e*, 18*e* includes two axially spaced-apart grooved portions 22, 24. Each grooved portion 22, 24 is typically around 30 inches (approximately 762 mm) in length.

The spaced-apart grooved portions 22, 24, best shown in FIG. 3, include a plurality of helical grooves 26. Twelve helical grooves 26 are milled into the enlarged diameter portions 16*e*, 18*e*. As can be seen from FIGS. 4, 5 and 7 in particular, six starting points are provided (labelled 1 to 6). Each starting point 1 to 6 is equally spaced around the circumference of the enlarged diameter portions 16*e*, 18*e* with a circumferential spacing of approximately 60° between each starting point 1 to 6. The grooves 26 are milled to have a radius of around 1-inch (approximately 25 mm), and typically have a maximum depth of around ¾ of an inch (approximately 19 mm).

A pair of grooves 26*a*, 26*b* and 26*c*, 26*d* to 26*k*, 26*l* diverge at an angle of around 20° with respect to one another from each starting point 1 to 6 (i.e., twelve grooves 26 in total are provided for this embodiment). It is to be noted that the cross-sectional shape of each groove 26 is substantially symmetrical, allowing for slight variations in the milling process.

As best shown in FIGS. 4 and 5, there is a 90° wrap between the starting points 1 to 6 in FIG. 4, and the end points 1 to 6 in FIG. 5. In other words, starting point 1 originates at the 0° point on the circumference as viewed in FIG. 4, and the grooves 26*a*, 26*b* that originate from starting point 1 curve around the enlarged portions 16*e*, 18*e* and end at point 1 in FIG. 5 that is shifted by 90° relative to the starting point 1 in FIG. 4. In FIGS. 4 and 5, the numbers 1 to 6 show respective starting and end points for each groove 26.

The milling of the helical grooves 26*a* to 26*l* creates a plurality of islands 28 therebetween, the radially outermost surface of which retains substantially the same diameter as the enlarged diameter portions 16*e*, 18*e*. Thus, the maximum outer diameter at each island 28 in this embodiment is around 6.5 inches (approximately 165 mm). In other embodiments the maximum OD at the grooved portion is around 6.75 inches (around 171 mm). The islands 28 formed by the milling process are typically diamond shaped.

As can be clearly seen from FIG. 6*b* in particular, each groove 26 intersects the other grooves 26, thereby forming a criss-cross pattern that defines the islands 28 and provides each island 28 with an angular peripheral edge that enhances the turbulence created when the tubular 10 is rotated in the borehole. The criss-cross pattern provides a large surface area that creates a relatively large turbulence in the borehole. This is advantageous as the turbulence in the borehole dislodges drill cuttings and other debris, which then become suspended in the drilling mud. Also, the intersection of the grooves 26 and the number of them facilitates an improved Archimedean screw effect to aid in transport or circulation of the cuttings and debris to the surface.

The intersections between the grooves 26 can further aid in increasing the amount of turbulence as drilling mud flowing up one groove 26 will contact fluid flowing up another groove 26 at the intersection thereof, thereby creating an increase in the turbulence.

The increased surface area formed by the criss-cross pattern and intersection of the grooves 26 also has the advantage that the grooves 26 are less likely to become clogged or blocked by cuttings and debris in the borehole. As each enlarged diameter portion 16*e*, 18*e* has twelve intersecting grooves 26, even if one or more of the grooves 26 do become blocked, a large number of unblocked grooves 26 remain and can thus still create a large turbulence in the borehole.

As the islands 28 are generally diamond shaped, four apexes 28*a* are provided, one apex 28*a* at each intersection between adjacent peripheral edges 28*p*.

As the tubular 10 rotates, at least one of the apexes 28*a* faces the direction of rotation, and thus provides a sharp cutting point. The sharp cutting point can be used to break-up debris and cuttings, and can also be used to cut into filtrate on the wall of the borehole. Additionally, four peripheral edges 28*p* are provided for each islands 28, and thus the angled peripheral edges 28*p* provide a relatively large cutting area.

Each peripheral edge 28*p* of each island 28 forms a cutter that can be used to remove any build up of cuttings or other solids from the inner wall of the borehole as the tubular 10 is rotated. The build-up of solids or filtrate on the face of the borehole is generally called "filter cake", and is generally thought to be caused by fluid (e.g. drilling mud) being lost into the formation because of a differential pressure between the borehole and the formation that causes the fluid to be forced from the high pressure borehole into the low pressure formation. Solid particles in the drilling mud separate out as the larger particles cannot pass into the formation because of the structure thereof (i.e. the formation acts like a sieve), and the particles tend to form a build-up of solids or filtrate on the wall of the borehole. The filtrate is generally a relatively thin coating of these larger particles on the borehole wall, and can help to seal and stabilise the borehole walls, which is advantageous. However, too much of this can cause downhole tubulars and other apparatus to stick to the walls, particularly when the tubulars stop moving, and the filtrate acts as a seal. This is known as differential sticking and can be problematic when drilling as the drill string formed from a variety of different tubulars (e.g. tubular 10, a drill bit and portions of drill pipe) can become differentially stuck against the borehole wall.

The peripheral edges 28*p* of the islands 28 can scrape at or cut away this build-up of filtrate on the borehole wall so that the amount of filtrate can be reduced and/or controlled, as will be described.

It is to be noted that the peripheral edges 28*p* of the islands 28 provide an overall large cutting surface area. Additionally, the peripheral edges 28*p* and/or an outer surface of the islands 28 can be flame-hardened, or faced with a hard wearing material such as tungsten carbide to reduce wear and increase the lifetime of the tubular 10 before it requires refurbishment.

In addition to the cutting action of the peripheral edges 28*p*, the creation of turbulence in the fluids adjacent the filter cake deposits will also have an abrasive effect on the deposit, without the result of increased wear on the peripheral edges 28*p*.

Referring again to FIGS. 1 and 7 in particular, the flexible joint 20 flexibly couples the first and second portions 16, 18 together so that they can bend or flex relative to one another to a certain extent. The flexible joint 20 includes two spaced-apart collars 30, 32 that typically have an outer diameter of 7 inches (178 mm), and a longitudinal length of around 16 inches (approximately 406 mm). The outer diameter of the collars 30, 32 is typically of the same order as the outer diameter of the box 12 and pin 14, but this is not essential.

A reduced diameter portion 34 is located between the two collars 30, 32, and it is the reduction in the diameter of the reduced diameter portion 34 that provides the flexibility between the first and second portions 16, 18. The flexibility between the two portions 16, 18 is particularly advantageous where the tubular 10 is being used in deviated, horizontal or lateral boreholes for example. The reduced diameter portion 34 typically has an outer diameter of around 5 inches (approximately 127 mm), and a longitudinal length of around 3 inches (approximately 76 mm).

The flexible joint 20 can also act as a stabiliser and/or centraliser of the downhole tubular 10 when in use, due to the slightly greater diameter thereof. Indeed, it may be advantageous to have the outer diameters of the collars 30, 32 and the pin 12 and box 14 substantially the same, as in this example, to increase stability of the tubular 10 and providing a centralising effect.

In use, the tubular 10 is coupled into a drill string at any convenient location using the pin 12 and box 14. A drill bit is typically located at a lower end of the drill string and is used to cut into the formation to create the borehole, the borehole facilitating the recovery of hydrocarbons to the surface, as is known in the art.

As the tubular 10 rotates with the drill string, the helical grooves 26 provide an Archimedean screw effect that causes a flow of drilling mud to the surface. The flow of drilling mud to the surface promoted by the tubular 10 contains drill cuttings and other debris that is suspended in the drilling mud and thus there is less debris and cuttings in the borehole that could prevent the string and/or drill bit from freely rotating. This is advantageous as the bit or string is less likely to become jammed or stuck due to a build up of cuttings and debris, thus saving on costs that would otherwise be incurred in freeing the stuck bit or string, and the time taken to free them. Consequently, there is the potential for less rig downtime due to efficient removal of the cuttings and debris.

The overall width of the grooves 26 can create a relatively large flow of drilling mud and debris to the surface, which is advantageous as the drilling action of the drill bit can create large amounts of cuttings and debris in the borehole that require to be removed. Additionally, as the grooves 26 are relatively wide and deep, there is a reduced likelihood of them being blocked or clogged by the debris and cuttings as they are transported to the surface.

Additionally, as the enlarged diameter portions 16*e*, 18*e* are each provided with twenty four grooves 26 in total, there is a large surface area that can create the Archimedean screw effect for inducing turbulence in the borehole and facilitating the circulation of drilling mud back to the surface. Also, the relatively large number of grooves 26 and in particular the intersections therebetween promote a significant turbulence in the borehole.

The islands 28, and in particular the peripheral edges 28*p* thereof, are not intended to mill or cut the borehole wall (although this remains an option by selecting the appropriate outer diameter of the enlarged diameter portions 16*e*, 18*e* relative to the inner diameter of the borehole), but are designed to cut away at the filtrate that builds up on the walls of the borehole. Thus, as the drill string is rotated, the islands 28 and edges 28*p* scrape or cut away at the filtrate. The cutting or scraping of the filtrate aids in controlling and/or reducing the build-up of filtrate so that the potential for differential sticking of the drill string can be reduced. This is particularly advantageous in deviated and horizontal boreholes.

It should be noted that the maximum overall diameter of the enlarged diameter portions 16*e*, 18*e* provided with the helical grooves 28 can be chosen relative to the inner diameter of the borehole so that only a minimal amount of filtrate is left after passage of the tubular 10 through the borehole. However, the amount of filtrate left should preferably provide a good seal at the formation.

Figure 8:
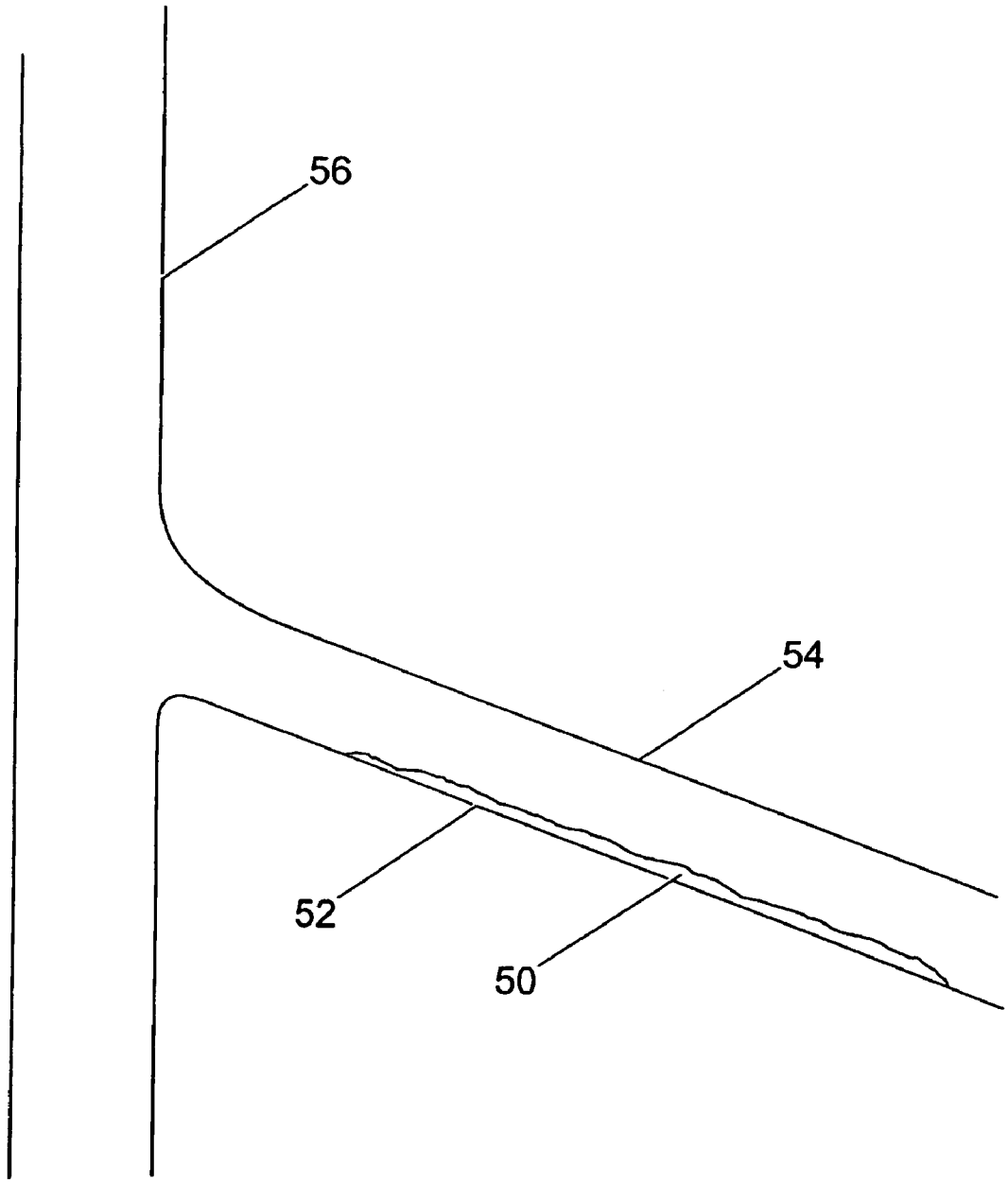
FIG. 8 is a schematic representation of a lateral borehole drilled from a main borehole.

Another use of the present invention is where a deviated, lateral or horizontal borehole is being drilled. Referring to FIG. 8, so-called "low-side cuttings" 50 often collect on a lower wall 52 of a lateral borehole 54 during drilling of the lateral 54 from a main borehole 56. The low-side cuttings 50 are formed as the cuttings and debris formed by the drill bit when drilling tend to fall under their own weight and gravity towards the lower wall 52 of the lateral 54 and collect there.

In this case, the tubular 10 can be used to cut or scrape away the low-side cuttings 50 using the islands 28 and the peripheral edges 28*p* thereof. Thus, as the tubular 10 rotates with the drill string, the islands 28 and edges 28*p* cut and scrape at the low-side cuttings 50, which are then collected and suspended in the drilling mud. The helical grooves 28 provide the Archimedean screw effect that causes the drilling fluid with the cuttings and debris suspended therein to be transported towards the surface. The drilling fluid can then be filtered or otherwise treated to remove the cuttings and debris for re-circulation.

The tubular 10 can be run through the open-hole portion of the borehole from adjacent the drill bit back to the surface. Indeed, a number of tubulars 10 can be used in the drill string at a plurality of spaced-apart locations along the length of the string. Forty to fifty of the tubulars 10 can be used in drill strings that are many kilometers in length, and this could be advantageous to ensure that the drilling mud including the drill cuttings and other debris suspended therein is transported back to the surface.

Embodiments of the present invention thus provide the advantage that drilling fluid is circulated back to the surface due to the helical grooves. As debris and cuttings are suspended in the fluid, then there is less unwanted material left in the borehole that could cause problems during the drilling operation, and the drill string has a lesser tendency to become blocked or jammed due to the presence of drill cuttings and debris.

Other advantages include the increased turbulence in the borehole that is particularly due to the intersection of the grooves that form a criss-cross pattern in certain embodiments.

Further, certain embodiments are particularly useful when drilling lateral, deviated and horizontal boreholes due to the islands forming cutters to remove the low-side cuttings. The flexible joint in certain embodiments allows the tubular to be used in deviated, horizontal and lateral boreholes due to the flexibility it provides to the tubular, facilitating manoeuvring of the drill string around bends.

Certain embodiments also offer the advantage that the amount of filtrate build-up on the borehole walls can be reduced and/or controlled, thereby reducing the tendency of the drill string to become differentially stuck.

Modifications and improvements may be made to the foregoing without departing from the scope of the present invention. For example, all dimensions quoted herein are exemplary only, and can be changed or varied to suit particular applications within the scope of the invention. The embodiment described herein has two grooved portions, but any number of these can be provided along the length of the tubular. Further, the overall length of the tubular can be varied, and could be a pup joint of around 15 feet (approximately 4.5 m), or any other suitable length, e.g. range 2 (31.5 feet, approximately 9.6 m) or range 3 (41 to 42 feet, approximately 12.5 to 13 m).

Additionally, the tubular has been described herein with reference to drilling boreholes to facilitate the recovery of hydrocarbons, but it will be appreciated that the tubular can be used in any drill string for drilling water wells for example, or any other borehole into the ground for whatever purpose.

Further, the description herein refers to a downhole tubular that has a longitudinal throughbore, but it need not have a throughbore and could be, for example, a solid member.

The invention claimed is:

1. A drill string member for insertion into a drill string, including:

at least one grooved portion comprising an outer surface having a plurality of grooves; and two axially spaced portions of larger diameter than the surface of the grooved portion;

wherein at least some of the grooves intersect with each other, and wherein, in use in a borehole, the larger diameter portions function to space the surface of the grooved portion radially inward from the borehole wall.

2. A member according to claim 1, wherein the grooves are arranged in pairs of diverging grooves with each pair beginning at one of a plurality of circumferentially spaced-apart starting points.

3. A member according to claim 2, wherein six starting points are provided, each starting point being equi-spaced around a circumference of the at least one grooved portion.

4. A member according to claim 2, wherein each pair of grooves diverges at an angle of around 20° between the diverging grooves from each starting point.

5. A member according to claim 2, wherein each groove is milled in a helix from each starting point to a circumferentially spaced end point.

6. A member according to claim 5, wherein each end point is circumferentially spaced from each starting point by around 90°.

7. A member according to claim 2, wherein each groove is milled in a helix from each starting point to an axially spaced end point.

8. A member according to claim 1, wherein the grooves define a plurality of islands therebetween.

9. A member according to claim 8, wherein the islands are formed by the intersections between the grooves.

10. A member according to claim 8, wherein the islands are diamond shaped.

11. A member according to claim 10, wherein at least one apex of at least one island faces in the direction of rotation of the member.

12. A member according to claim 1, wherein the grooves create a plurality of cutters.

13. A member according to claim 12, wherein the cutters are formed by peripheral edges of islands.

14. A member according to claim 12, wherein at least two cutters face the direction of rotation.

15. A member according to claim 1, wherein the at least one grooved portion is provided on an enlarged diameter portion.

16. A member according to claim 1, wherein the member includes two axially spaced-apart nominal diameter portions, with a pair of axially spaced-apart enlarged diameter portions on each nominal diameter portion.

17. A member according to claim 1, incorporating a flexible coupling.

18. A member according to claim 17, wherein the flexible coupling includes two axially spaced-apart collars with a reduced diameter portion between the collars.

19. A drill string member for insertion into a drill string, including:

at least one grooved portion comprising an outer surface having a plurality of grooves; and two axially spaced portions of larger diameter than the surface of the grooved portion;

wherein at least some of the grooves intersect with each other, and wherein the at least one grooved portion is located between the two axially spaced portions of larger diameter, such that, in use in a borehole, the larger diameter portions function to space the surface of the grooved portion radially inward from the borehole wall.

* * * * *